US006772743B2

(12) United States Patent
Nydam

(10) Patent No.: US 6,772,743 B2
(45) Date of Patent: Aug. 10, 2004

(54) REDUCING ARMATURE FRICTION IN AN ELECTRIC-ACTUATED AUTOMOTIVE EMISSION CONTROL VALVE

(75) Inventor: Kenneth Peter Nydam, Chatham (CA)

(73) Assignee: Siemens VDO Automotive Inc., Chatham, CA (US)

( * ) Notice: Subject to any disclaimer, the term of this patent is extended or adjusted under 35 U.S.C. 154(b) by 122 days.

(21) Appl. No.: 09/882,204

(22) Filed: Jun. 15, 2001

(65) Prior Publication Data

US 2002/0189600 A1 Dec. 19, 2002

(51) Int. Cl.[7] ..... F02M 25/07

(52) U.S. Cl. ..... 123/568.21; 251/129.15; 335/219; 335/255

(58) Field of Search ..... 123/568.21; 251/129.15; 335/219, 255, 261, 278, 220

(56) References Cited

U.S. PATENT DOCUMENTS

| | | | | |
|---|---|---|---|---|
| 5,467,962 A | * | 11/1995 | Bircann et al. | 251/129.15 |
| 5,494,255 A | * | 2/1996 | Pearson et al. | 251/129.15 |
| 5,911,401 A | | 6/1999 | Hrytzak et al. | 251/129.15 |
| 5,950,605 A | | 9/1999 | Hussey et al. | 123/568.26 |
| 5,957,117 A | | 9/1999 | Everingham | 123/568.26 |
| 5,960,776 A | | 10/1999 | Everingham et al. | 123/568.26 |
| 6,209,529 B1 | | 4/2001 | Everingham | 123/568.2 |
| 6,422,223 B2 | * | 7/2002 | Meilinger et al. | 123/568.21 |

OTHER PUBLICATIONS

US 6,095,122, 8/2000, Everingham (withdrawn)

* cited by examiner

*Primary Examiner*—Mahmoud Gimie
*Assistant Examiner*—Arnold Castro

(57) ABSTRACT

An emission control valve is operated by an electric actuator that has an electric coil, stator structure, and a positioning mechanism, including an armature that is selectively positionable along an axis, for selectively positioning a valve element. The stator structure is separated from the armature by an air gap that includes a non-ferromagnetic guide sleeve that is in surface-to-surface contact with the armature for guiding armature motion along the axis. The guide sleeve and the stator structure are in surface-to-surface contact for mutually concentricity with the axis. Along a region of mutual overlapping a minimum air gap is provided between the guide sleeve and the stator structure by radial spacing between the stator structure and the guide sleeve. Various embodiments are disclosed.

8 Claims, 6 Drawing Sheets

REDUCING ARMATURE FRICTION IN AN ELECTRIC-ACTUATED AUTOMOTIVE EMISSION CONTROL VALVE

FIELD OF THE INVENTION

This invention relates to electric-actuated emission control valves of automotive vehicles, especially to a valve that comprises a non-magnetic sleeve that guides motion of a magnetic armature that controls the extent to which the valve selectively restricts a flow passage.

BACKGROUND OF THE INVENTION

Controlled engine exhaust gas recirculation (EGR) is a known technique for reducing oxides of nitrogen in products of combustion that are exhausted from an internal combustion engine to atmosphere. A known EGR system comprises an EGR valve that is controlled in accordance with engine operating conditions to regulate the amount of engine exhaust gas that is recirculated to the induction fuel-air flow entering the engine for combustion so as to limit the combustion temperature and hence reduce the formation of oxides of nitrogen.

Electric-actuated EGR valves (EEGR valves) are capable of controlling recirculation of exhaust gas with the precision needed to comply with relevant emission regulations. However, increasingly stringent regulations create need for further improvements in EEGR valves. An EEGR valve that possesses more accurate and quicker response can be advantageous in achieving improved control of tailpipe emissions, improved driveability, and/or improved fuel economy for a vehicle having an internal combustion engine that is equipped with an EGR system.

A known electric actuator for a valve, such as an emission control valve, is a solenoid actuator having an armature that is selectively positioned along an axis according to the extent to which an electric coil of the actuator is energized by electric current. Various patents disclose emission control valves having linear solenoid actuators for improved accuracy in positioning the armature. Where the armature travel is guided by some sort of guide, frictional forces can affect positioning accuracy. In certain actuators, the armature is guided by a non-ferromagnetic sleeve that spaces the armature from surrounding stator structure of the solenoid. The armature is in surface-to-surface contact with the guide sleeve that provides a close sliding fit of the armature within the guide sleeve. Various patents show arrangements for guiding an armature within a solenoid to reduce sliding friction, but they may involve the inclusion of additional parts such as bearing rings, spheres, etc.

SUMMARY OF THE INVENTION

The present invention relates to improvements for reducing the friction that is encountered by an armature of an EEGR valve when an electric control signal applied to the valve commands armature movement for changing the extent to which the valve restricts exhaust gas recirculation. The invention arises through the discovery that radial components of the magnetic field that act on the armature create radial force components that affect the friction that the armature encounters as it moves axially within a nonmagnetic sleeve that guides the axial armature motion. The extent to which the centerline of the armature departs from concentricity with the centerline of the electromagnet coil that creates the magnetic field also affects the friction. The invention provides a solution that reduces the influence of radial components of the magnetic field on the armature, and consequently diminishes the frictional forces that the armature encounters as it travels within the sleeve. It is believed that these reductions in friction can provide meaningful improvements in valve response and accuracy without the inclusion of additional parts such as bearing rings, and without significantly altering the functional relationship of axial force versus coil current.

While establishing the best concentricity of the armature to the coil and associated stator structure is also important in reducing armature friction, the invention is able to reduce armature friction in conditions of less than perfect concentricity. The invention accomplishes this by providing a minimum air gap between the stator structure and the armature, the minimum air gap being provided by spacing a hub of a stator pole piece from a non-ferromagnetic guide sleeve along a region of mutual axial overlap. Various specific embodiments are disclosed.

One general aspect of the present invention relates to an emission control valve for controlling flow of gases with respect to combustion chamber space of an internal combustion engine. The valve comprises a housing having a passage that has an inlet port for receiving gases, an outlet port for delivering gases to the combustion chamber space, and a valve element that is selectively positioned by an electric actuator to selectively restrict the passage. The actuator comprises a solenoid having an electric coil, stator structure, and a positioning mechanism, including an armature that is selectively positionable along an axis, for selectively positioning the valve element. The stator structure and the armature cooperatively form a magnetic circuit in which the coil, when energized by electric current, creates magnetic flux for selectively positioning the armature along the axis. The stator structure is separated from the armature by an air gap that includes a non-ferromagnetic guide sleeve that is in surface-to-surface contact with the armature for guiding armature motion along the axis. The guide sleeve and the stator structure are mutually overlapping along a region of the axis and are fit to substantial mutual concentricity with the axis, and at that region, the air gap includes a minimum air gap provided by radial spacing between the stator structure and the guide sleeve.

Another general aspect of the present invention relates to an automotive vehicle emission control system that includes a valve, as described above, for controlling flow of gases with respect to combustion chamber space of an internal combustion engine that powers the vehicle.

Still another general aspect of the present invention relates to a method of reducing friction between an armature and a non-ferromagnetic guide sleeve of an electric actuator of an automotive vehicle emission control valve wherein the guide sleeve has surface-to-surface contact with the armature for guiding armature motion along an axis while separating the armature from stator structure of the actuator by an air gap. The method comprises disposing the guide sleeve and the stator structure in mutually overlapping axial relation along a region of the axis, fitting the guide sleeve and the stator structure to substantial mutual concentricity with the axis, and at the mutually overlapping region, providing a minimum air gap by radially spacing the stator structure from the guide sleeve.

The foregoing, and other features, along with various advantages and benefits of the invention, will be seen in the ensuing description and claims which are accompanied by drawings. The drawings, which are incorporated herein and constitute part of this specification, disclose a preferred embodiment of the invention according to the best mode contemplated at this time for carrying out the invention.

DESCRIPTION OF THE PREFERRED EMBODIMENT

Figure 1:
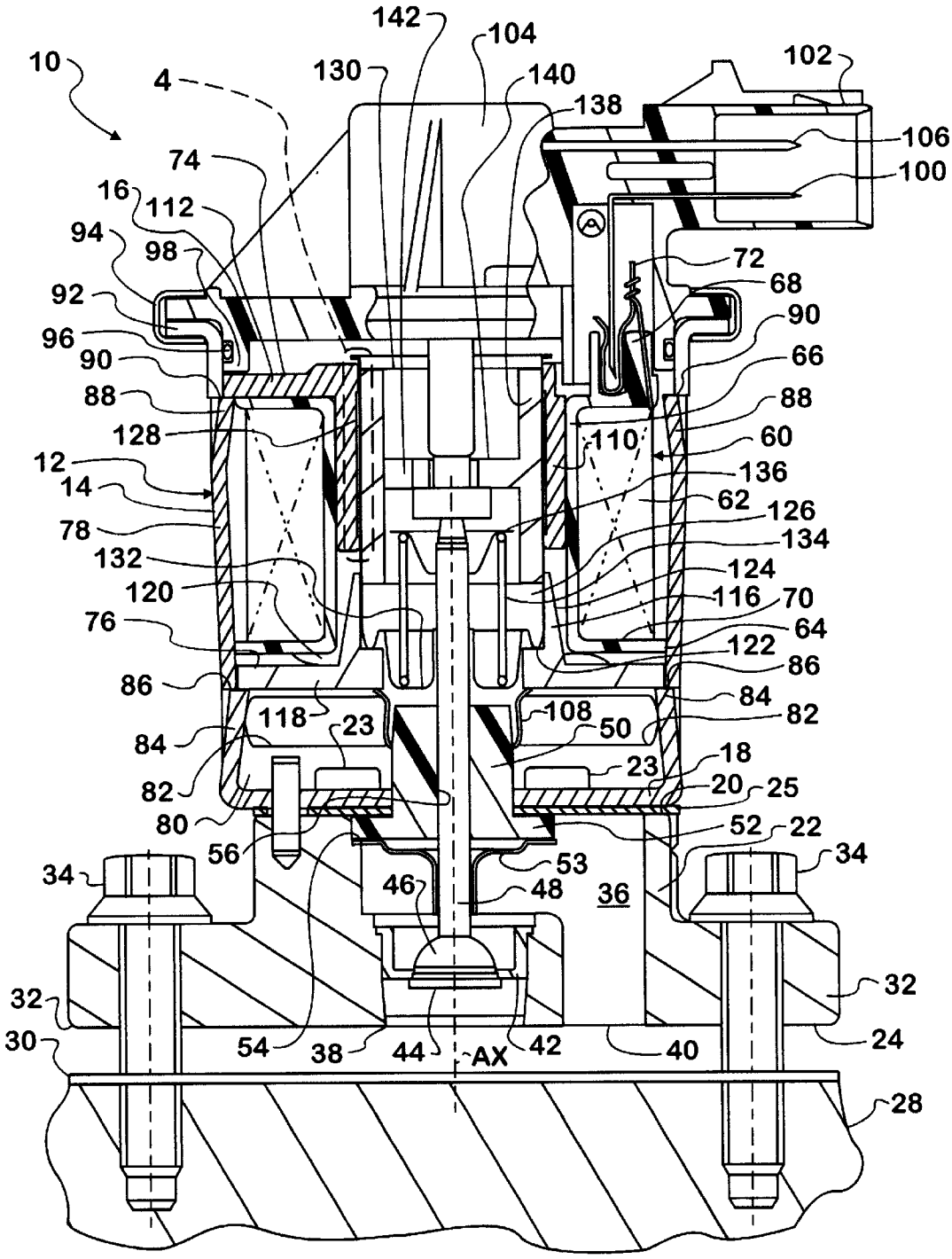
FIG. 1 is a longitudinal cross section view through an exemplary automotive emission control valve, an EEGR valve in particular, embodying principles of the present invention.

FIG. 1 shows an exemplary EEGR valve 10 that comprises a housing assembly 12 provided by a shell 14 having an open upper end that is closed by a cap 16. Shell 14 further comprises a flat bottom wall 18 that is disposed atop a flat upper surface 20 of a base 22. Fasteners 23 pass through holes in bottom wall 18 and an intervening spacer 25 to secure the shell on the base. Base 22 comprises a flat bottom surface 24 that is adapted to be disposed on a flat mounting surface 26 of a component of an internal combustion, such as a manifold 28, typically with an intervening insulator gasket 30. Apertured feet 32 protrude from the side of base 22 to provide for fastening of valve 10 to manifold 28 by threaded fasteners 34.

Valve 10 comprises a flow passage 36 extending through base 22 between an inlet port 38 and an outlet port 40. With valve 10 mounted on the engine, inlet port 38 is placed in communication with engine exhaust gas expelled from the engine cylinders and outlet port 40 is placed in communication with the intake flow into the cylinders.

A valve seat element 42 is disposed in passage 36 proximate inlet port 38 with the outer perimeter of the seat element sealed to the passage wall. Valve seat 42 has an annular shape comprising a through-hole. A one-piece valve member 44 comprises a valve head 46 and a valve stem 48 extending co-axially from head 46 along a central longitudinal axis AX of the valve. Head 46 is shaped for cooperation with seat element 42 to close the through-hole in the seat element when valve 10 is in closed position shown in FIG. 1.

Valve 10 further comprises a bearing member 50 which is basically a circular cylindrical member except for a circular flange 52 at its lower end. An upper rim flange of a multi-shouldered deflector member 53 is axially captured between flange 52 and a shoulder 54 of base 22. Deflector member 53 is a metal part shaped to shield bearing member 50 and a portion of stem 48 below the bearing member. Deflector member 53 terminates a distance from valve head 46 so as not to restrict exhaust gas flow through passage 36, but at least to some extent deflect the gas away from stem 48 and bearing member 50.

Bearing member 50 further comprises a central circular through-hole, or through-bore, 56 with which stem 48 has a close sliding fit. Bearing member 50 may comprise a material that possesses some degree of lubricity providing for low-friction guidance of valve member 44 along axis AX.

Valve 10 further comprises an electromagnetic actuator 60, namely a solenoid, disposed within shell 14 coaxial with axis AX. Actuator 60 comprises an electromagnetic coil 62 and a polymeric bobbin 64. Bobbin 64 comprises a central tubular core 66 and flanges 68, 70 at opposite ends of core 66. Coil 62 comprises a length of magnet wire wound around core 66 between flanges 68, 70. Respective terminations of the magnet wire are joined to respective electric terminals mounted side-by-side on flange 68, only one terminal 72 appearing in the view of FIG. 1.

Actuator 60 comprises stator structure associated with coil 62 to form a portion of a magnetic circuit path. The stator structure comprises an upper pole piece 74, disposed at one end of the actuator coaxial with axis AX, and a lower pole piece 76 disposed at the opposite end of the actuator coaxial with axis AX. Shell 14 comprises a side wall 78, a portion of which extends between pole pieces 74, 76 to complete the stator structure exterior of the coil and bobbin.

An annular air circulation space 80 is provided within shell 14 axially below actuator 60. This air space is open to the exterior by several air circulation apertures, or through-openings, 82 extending through shell 14. Side wall 78 has a slight taper that narrows in the direction toward bottom wall 18. In the portion of the shell side wall that bounds space 80, several circumferentially spaced tabs 84 are lanced inwardly from the side wall material to provide rest surfaces 86 on which lower pole piece 76 rests. Proximate its open upper end, the shell side wall contains similar tabs 88 that provide rest surfaces 90 on which upper pole piece 74 rests. Cap 16 comprises an outer margin that is held secure against a rim 92 at the otherwise open end of the shell side wall by a clinch ring 94. A circular seal 96 is disposed between the cap and shell to make a sealed joint between them.

The interior face of cap 16 comprises several formations 98 that engage upper pole piece 74 to hold the latter against rest surfaces 90 thereby axially locating the upper pole piece to the shell. Cap 16 comprises a first pair of electric terminals, only one terminal 100 appearing in FIG. 1, that mate respectively with the terminals on bobbin flange 68. The cap terminals protrude externally from the cap material where they are bounded by a surround 102 of the cap material to form a connector adapted for mating connection with a wiring harness connector (not shown) for connecting the actuator to an electric control circuit.

Cap 16 also comprises a tower 104 providing an internal space for a position sensor that comprises plural electric terminals, only one terminal 106 appearing in the Figure, that protrude into the surround for connecting the sensor with a circuit via the mating wiring harness connector.

The construction of valve 10 is such that leakage between passage 36 and air circulation space 80 is prevented. Bearing member through-hole 56 is open to passage 36, but valve stem 48 has a sufficiently close sliding fit therein to substantially occlude the through-hole and prevent leakage between passage 36 and air circulation space 80 while providing low-friction guidance of the stem along axis AX.

Within space 80, a deflector 108 circumferentially bounds the portion of stem 48 that passes through the space. The construction of deflector 108 comprises a circular cylindrical thin-walled member whose opposite axial ends are fit to the lower pole piece and the bearing member thus forming a barrier that prevents foreign material, muddy water for example, from intruding into space 80 and fouling the stem.

Upper pole piece 74 is a ferromagnetic part that comprises a central, cylindrical-walled, axially-extending hub 110 and a circular radial flange 112 at one end of hub 110. Hub 110 is disposed co-axially within the upper end of a circular through-hole in bobbin core 66 concentric with axis AX, and flange 112 is disposed against bobbin flange 68, thereby axially and radially relating bobbin 64 and upper pole piece 74. Flange 112 has a clearance slot for the bobbin terminals.

Lower pole piece 76 comprises a ferromagnetic part having a central cylindrical hub 116 and a circular flange 118 at the lower end of hub 116. An annular wave spring 120 is disposed around hub 116 and between flange 118 and bobbin flange 70 for the purpose of maintaining bobbin flange 68 against flange 112 while allowing for possible effects of differential thermal expansion. In this way, a controlled dimensional relationship which is insensitive to external influences, such as temperature changes, is maintained between the two pole pieces and the bobbin-mounted coil.

Hub 116 extends from flange 118 into the bobbin core through-hole, but stops short of hub 110 of upper pole piece 74. Hub 116 comprises a circular through-hole that is concentric with axis AX and that has a shoulder 122 facing the end of the through-hole that is toward upper pole piece 74. The radially outer surface of the hub wall has a frusto-conical taper 124 that extends from flange 118 to the end of the hub that is disposed within the bobbin core through-hole. This imparts a narrowing taper to the hub wall in the direction of upper pole piece 74. Above shoulder 122, the through-hole in hub 116 has a diameter that is substantially equal to the nominal diameter of a circular through-hole in hub 110, with both being concentric with axis AX.

A non-ferromagnetic part 126 axially spans hubs 110 and 116 to provide both an armature guide 128 for a magnetic armature 130 of actuator 60 and a spring seat 132 for one end of a helical coil spring 134 that acts on valve element 44 to bias valve head 46 toward seating closed on seat element 42. Spring seat 132 has a central clearance hole for valve stem 48. A separate spring seat element 136 is secured to stem 42 beyond spring seat 132 to provide a seat for the other end of spring 134. Part 126 may comprise aluminum or aluminum alloy that can be drawn to the illustrated shape. Part 126 comprises a circular cylindrical sleeve forming a side wall that is fit to the through-holes in the respective hubs 110, 116 so as to make armature guide 128 concentric with axis AX. Where seat 132 joins guide 128, part 126 has an undulating flange for seating part 126 on shoulder 122 of lower pole piece 76.

Armature 130 cooperates with the stator structure to form the magnetic circuit of actuator 60. Armature 130 comprises a circular cylindrical outer wall 138 of suitable radial thickness for the magnetic flux that it conducts. Midway between its opposite ends armature 130 has a transverse wall 140 that serves to provide a point for operative connection of stem 48 to the armature such that motion of the armature along axis AX is transmitted through stem 48 to position valve head 44 relative to seat element 42, thereby setting the extent to which valve element 44 allows flow through passage 36. Wall 140 also provides a means for transmitting armature motion to the position sensor housed within tower 104. The outside diameter of wall 138 is dimensioned for a close fit within armature guide 128 so that the latter can provide precise axial guidance of armature travel.

FIG. 1 shows the closed position of valve 10 wherein spring 134 is pre-loaded, forcing valve head 46 to seat on seat element 42, closing passage 36 to flow between ports 38 and 40. The effect of spring 134 also biases the end of stem 48 against transverse wall 140 of armature 130 to form a single load operative connection between the armature and the stem. The nature of such a connection provides for slight relative movement between the two such that force transmitted from one to the other is essentially exclusively axial.

As electric current begins to increasingly flow through coil 62, the magnetic circuit exerts increasing force urging armature 130 in the downward direction as viewed in FIG. 1. Once the force is large enough to overcome the bias of the pre-load force of spring 134, armature 130 begins to move downward, similarly moving valve element 44 and opening valve 10 to allow flow through passage 36 between the two ports. The extent to which the valve is allowed to open is controlled by the electric current in coil 62, and by tracking the extent of valve motion, the position sensor can provide a feedback signal representing valve position, and hence the extent of valve opening. The actual control strategy for the valve is determined as part of the overall engine control strategy embodied by an associated electronic engine control. One or more through-holes 142 that extend through wall 140 provide for the equalization of air pressure at opposite axial ends of the armature.

Figure 4:
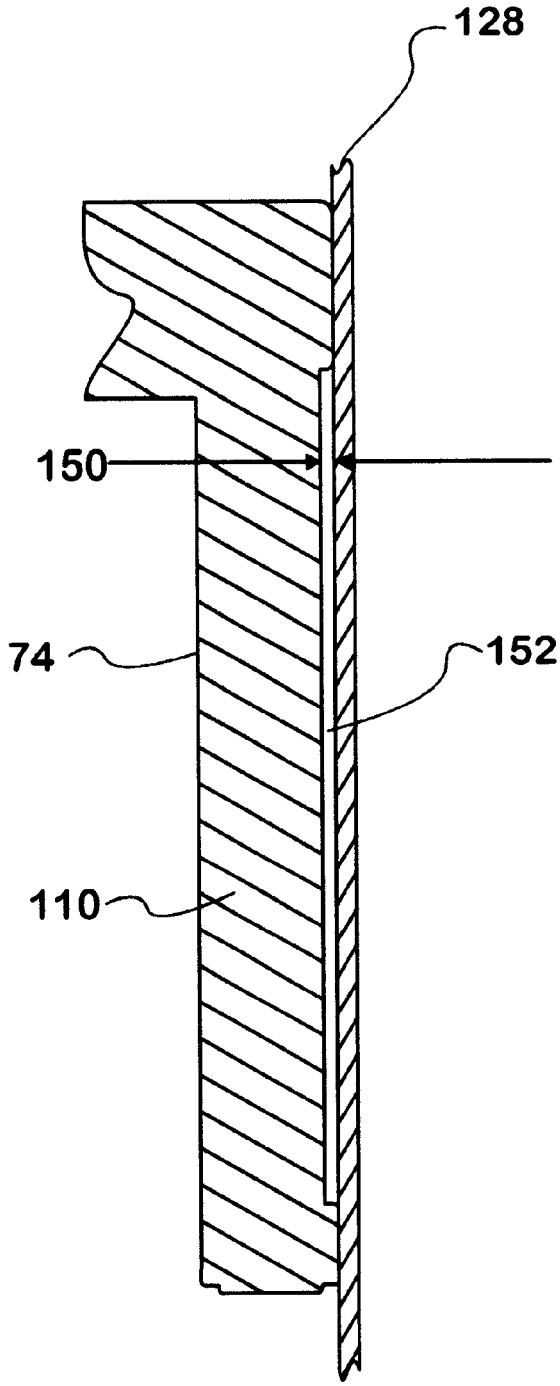
FIG. 4 is an enlarged view in oval 4 of FIG. 1.

In accordance with certain principles of the invention more fully seen in FIG. 4, a minimum air gap 150 is provided between the stator structure and armature 130. The minimum air gap is defined between the radially inner surface of hub 110 of upper pole piece 74 and the radially outer surface of armature guide 128 along a portion of the length of the axial overlap of the two respective parts 74 and 126 by a groove 152 in the radially inner surface of the former part. The groove extends around the full circumference of hub 110 and is rectangular in cross section. The combination of the minimum air gap and of substantial axial concentricity of armature guide 128 to coil 62 and its associated stator structure established in any suitable manner, such as by surface-to-surface fitting of part 126 to at least one of the pole pieces, is believed to provide a magnetic circuit flux whose radial components have reduced influence on the armature, thereby reducing surface friction between the armature and the armature guide. By avoiding the inclusion of additional parts such as bearing rings or the like, the valve can be more compact and cost effective.

Figure 2:
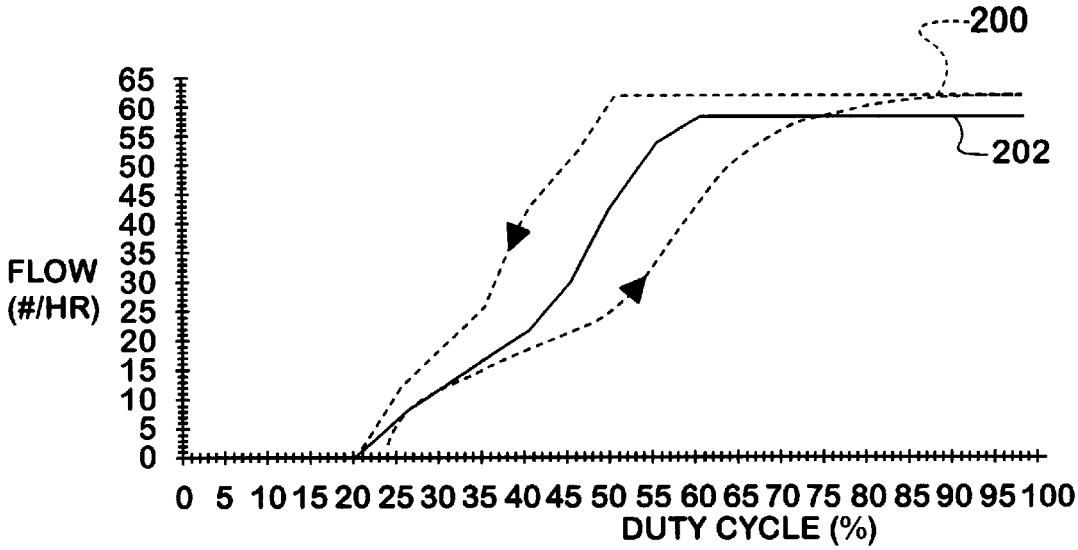
FIGS. 2 and 3 are respective graph plots useful in appreciating how the present invention can provide improved control of an EEGR valve.

Experimental testing has shown that the upper pole piece 74 has substantial influence on valve operation. FIG. 2 comprises two graph plots relating flow through the valve to the degree of modulation of a pulse width modulated duty cycle signal that energizes the solenoid coil. One graph plot 200 shows the substantial hysteresis that is present in a prior valve when relatively higher radial components of magnetic force, and resulting friction, are present between the guide sleeve and the armature. Such higher force and friction are attributable to lack of concentricity and of minimum air gap between the stator pole piece and the armature. Graph plot 202 shows how hysteresis can be significantly reduced by the present invention.

Figure 3:
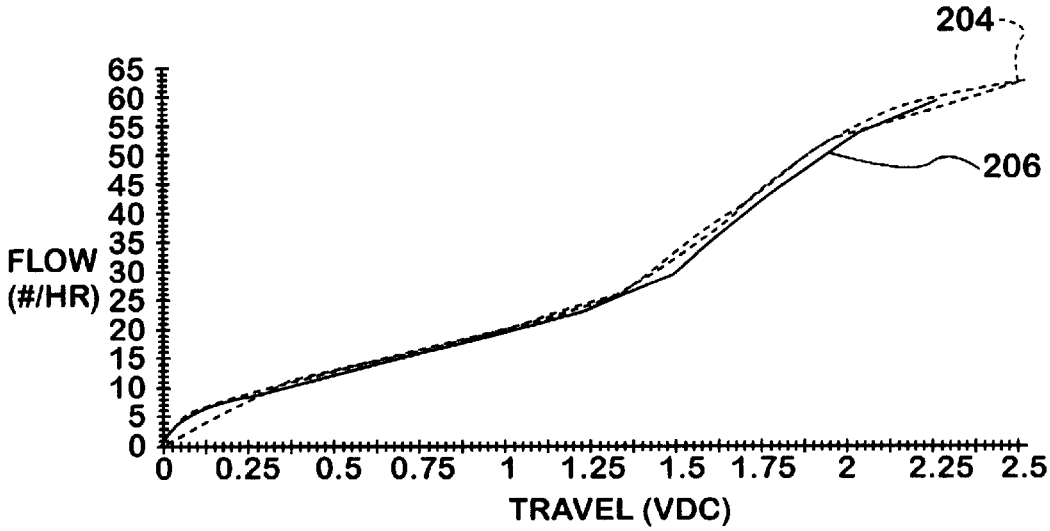

FIG. 3 shows graph plots 204, 206, correlated with graph plots 200, 202 respectively, of flow as a function of valve travel, as measured by the position sensor in cap 16. This Figure discloses that the inclusion of minimum air gap reduces hysteresis without significantly altering the overall functional relationship between flow through the valve and the position of the armature.

Figure 5:
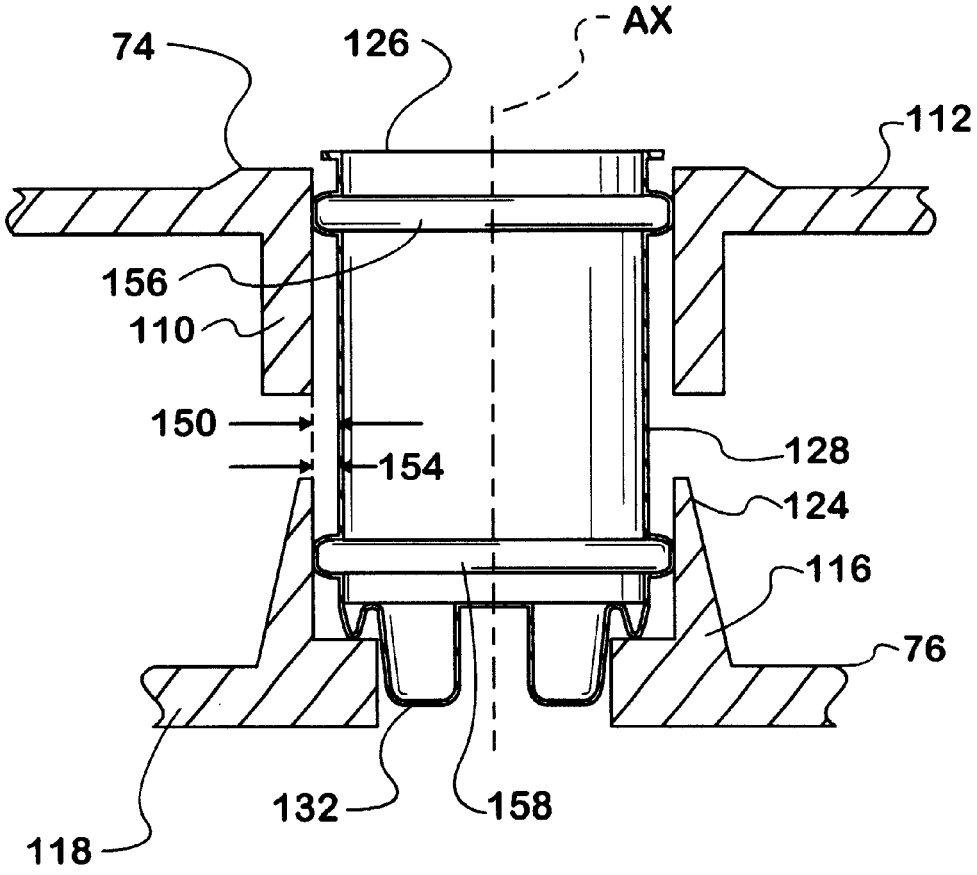
FIG. 5 is a view similar to FIG. 1, but with certain elements omitted, showing another embodiment.

FIG. 5 illustrates a second example where a first minimum air gap 150 is provided between the radially inner surface of hub 110 of upper pole piece 74 and the radially outer surface of armature guide 128 along a portion of the length of the axial overlap of the two respective parts 74 and 126, and a second minimum air gap 154 is provided between the radially inner surface of hub 116 of lower pole piece 76 and the radially outer surface of armature guide 128 along a portion of the length of the axial overlap of the two respective parts 76 and 126. The respective minimum air gaps are created by forming respective beads 156, 158 in the sleeve of part 126 that forms armature guide 128. Each bead extends around the full circumference of the sleeve and bulges radially outward in a generally semi-circular cross section. The crest of each bead has surface-to-surface contact with the inner surface of the respective hub.

Figure 6:
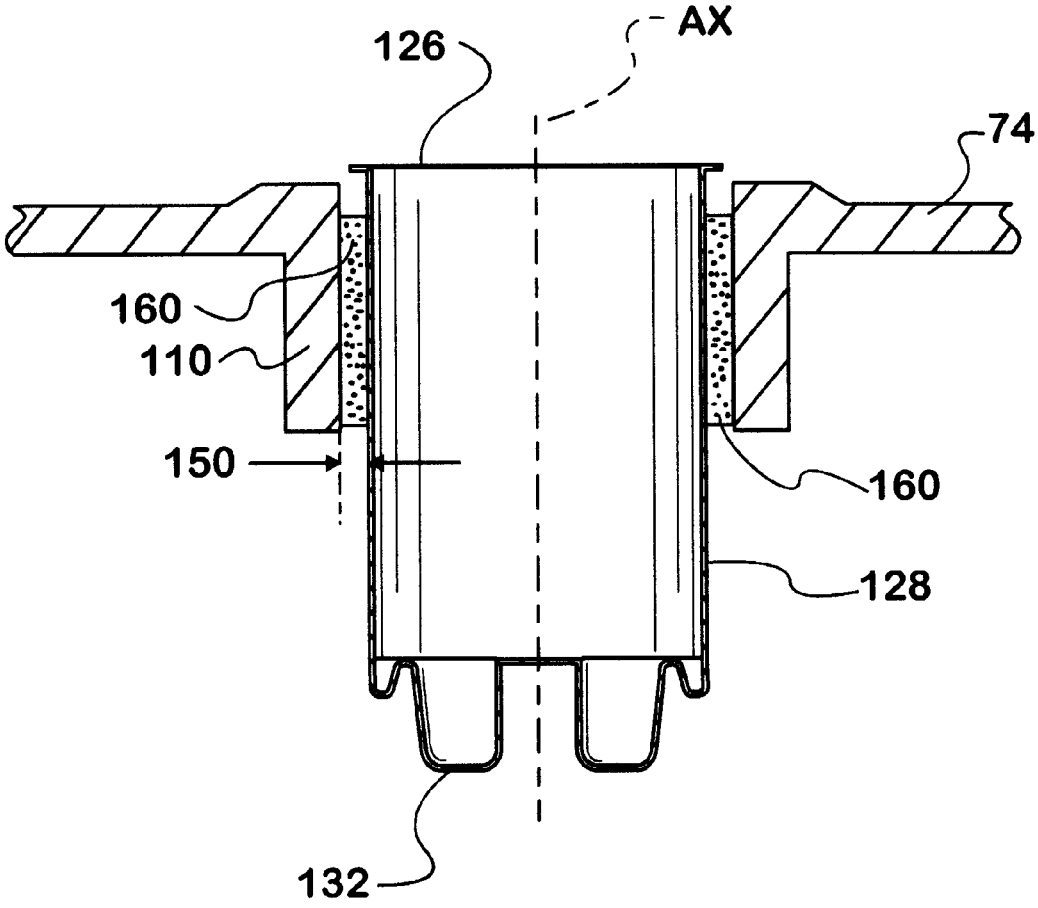
FIG. 6 is a view similar to FIG. 5 showing still another embodiment.

FIG. 6 illustrates a third example where a first minimum air gap 150 is provided between the radially inner surface of hub 110 of upper pole piece 74 and the radially outer surface of armature guide 128 along a portion of the length of the axial overlap of the two respective parts 74 and 126. The minimum air gap is created by dimensioning the outside diameter of the sleeve of part 126 less than the inside diameter of hub 110 by the thickness of a circular cylindrical spacer 160 that is disposed between the two parts 74, 126. The spacer may be any suitable non-ferromagnetic material, and it may be fit, or applied, to either part. Tape is one example of a suitable spacer material.

Figure 7:
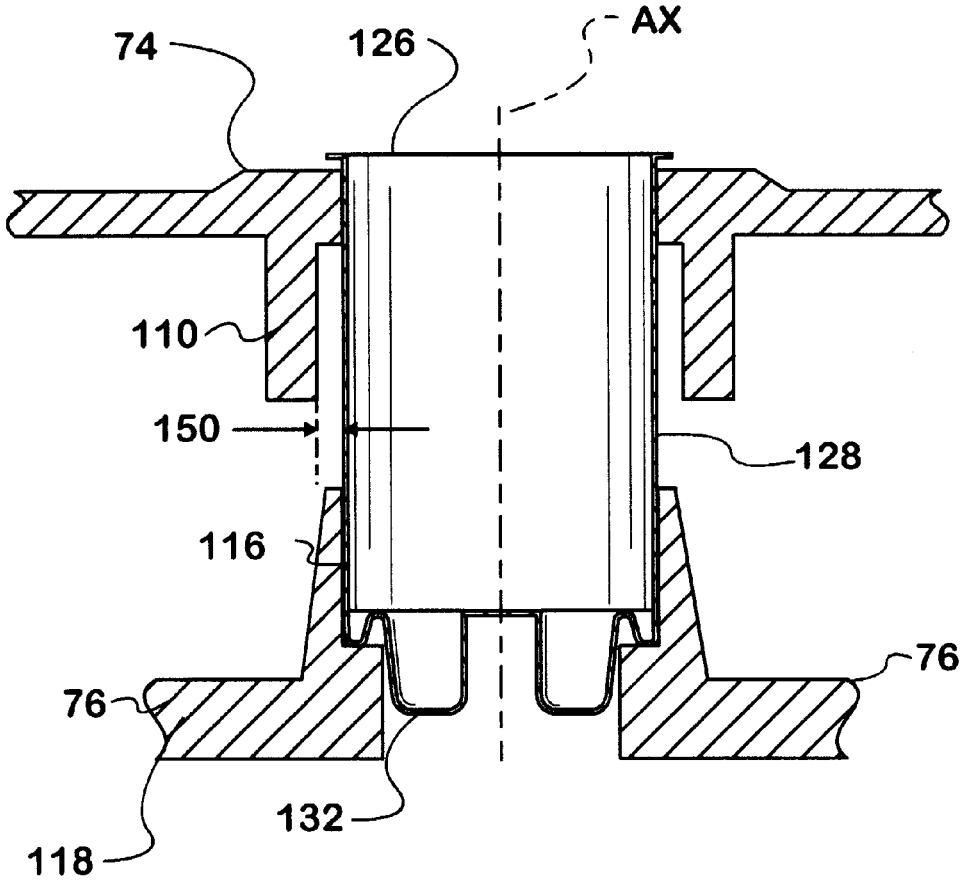
FIG. 7 is a view similar to FIG. 5 showing still another embodiment.

FIG. 7 illustrates a fourth example where a first minimum air gap 150 is provided between the radially inner surface of hub 110 of upper pole piece 74 and the radially outer surface of armature guide 128 along a portion of the length of the axial overlap of the two respective parts 74 and 126. The minimum air gap is similar to the first example of FIG. 4 except for the fact that the groove is extended to the inner end of hub 110.

While a presently preferred embodiment of the invention has been illustrated and described, it should be appreciated that principles are applicable to other embodiments that fall within the scope of the following claims. For example, it is believed that principles of the invention may be incorporated in various forms of automotive emission control valves.

What is claimed is:

1. An emission control valve for controlling flow of gases with respect to combustion chamber space of an internal combustion engine comprising:

a housing comprising a passage having an inlet port for receiving gases, an outlet port for delivering gases to the combustion chamber space, and a valve element that is selectively positioned by an electric actuator to selectively restrict the passage, wherein, the actuator comprises a solenoid having an electric coil, stator structure, and a positioning mechanism, including an armature that is selectively positionable along an axis, for selectively positioning the valve element, the stator structure and the armature cooperatively form a magnetic circuit in which the coil, when energized by electric current, creates magnetic flux for selectively positioning the armature along the axis, the stator structure is separated from the armature by an air gap that includes a non-ferromagnetic guide sleeve that is substantially concentric with the axis and in surface-to-surface contact with the armature for guiding armature motion along the axis, the stator structure comprises a pole piece having a cylindrical hub, and the guide sleeve comprises a radially outward protruding bead having surface-to surface contact with the hub to provide a minimum air gap between the armature and hub by radial spacing of the guide sleeve from the hub along an axial extent of the guide sleeve immediately adjoining the bead.

2. An emission control valve for controlling flow of gases with respect to combustion chamber space of an internal combustion engine comprising:

a housing comprising a passage having an inlet port for receiving gases, an outlet port for delivering gases to the combustion chamber space, and a valve element that is selectively positioned by an electric actuator to selectively restrict the passage, wherein, the actuator comprises a solenoid having an electric coil, stator structure, and a positioning mechanism, including an armature that is selectively positionable along an axis, for selectively positioning the valve element, the stator structure and the armature cooperatively form a magnetic circuit in which the coil, when energized by electric current, creates magnetic flux for selectively positioning the armature along the axis, the stator structure is separated from the armature by an air gap that includes a non-ferromagnetic guide sleeve that is in surface-to-surface contact with the armature for guiding armature motion along the axis, the guide sleeve and the stator structure are mutually overlapping along a region of the axis and are fit to substantial mutual concentricity with the axis, and at that region, the air gap includes a minimum air gap provided by radial spacing between the stator structure and the guide sleeve, the stator structure comprises a pole piece having a cylindrical hub at one portion of which the guide sleeve is fit to substantial mutual concentricity with the axis by mutual surface-to-surface contact and another portion of which is spaced radially from the guide sleeve to provide the minimum air gap, the one portion of the hub to which the guide sleeve is fit comprises a nominal inside diameter surface of the hub and the portion of the hub which is spaced radially from the guide sleeve to provide the minimum air gap comprises an undercut having an inside diameter surface radially outward of the nominal inside diameter surface, and extending axially to an axial end of the hub.

3. An emission control valve as set forth in claim 2 wherein the mechanism comprises a spring that resiliently biases the valve element toward closure of the passage, and the energization of the coil operates the valve element against the spring bias to open the passage.

4. An emission control valve for controlling flow of gases with respect to combustion chamber space of an internal combustion engine comprising:

a housing comprising a passage having an inlet port for receiving gases, an outlet port for delivering gases to the combustion chamber space, and a valve element that is selectively positioned by an electric actuator to selectively restrict the passage, wherein, the actuator comprises a solenoid having an electric coil, stator structure, and a positioning mechanism, including an armature that is selectively positionable along an axis, for selectively positioning the valve element, the stator structure and the armature cooperatively form a magnetic circuit in which the coil, when energized by electric current, creates magnetic flux for selectively positioning the armature along the axis, the stator structure is separated from the armature by an air gap that includes a non-ferromagnetic guide sleeve that is in surface-to-surface contact with the armature for guiding armature motion along the axis, the guide sleeve and the stator structure are mutually overlapping along a region of the axis and are fit to substantial mutual concentricity with the axis, and at that region, the air gap includes a minimum air gap provided by radial spacing between the stator structure and the guide sleeve, wherein the stator structure comprises a first pole piece having a cylindrical hub at one axial end of the guide sleeve and second pole piece having a cylindrical hub at the other axial end of the guide sleeve, and wherein the guide sleeve is fit to substantial mutual concentricity with the axis by mutual surface-to-surface contact with the hub of one of the pole pieces and the minimum air gap is disposed at the hub of the other pole piece, and wherein the minimum air gap comprises the hub of the other pole piece being spaced radially outward of the guide sleeve and a non-ferromagnetic ring filling space between the hub of the other pole piece and the guide sleeve.

5. An emission control valve as set forth in claim 4 wherein the mechanism comprises a spring that resiliently biases the valve element toward closure of the passage, and the energization of the coil operates the valve element against the spring bias to open the passage.

6. An emission control valve for controlling flow of gases with respect to combustion chamber space of an internal combustion engine comprising:

a housing comprising a passage having an inlet port for receiving gases, an outlet port for delivering gases to the combustion chamber space, and a valve element that is selectively positioned by an electric actuator to selectively restrict the passage, wherein, the actuator comprises a solenoid having an electric coil, stator structure, and a positioning mechanism, including an armature that is selectively positionable along an axis, for selectively positioning the valve element, the stator structure and the armature cooperatively form a magnetic circuit in which the coil, when energized by electric current, creates magnetic flux for selectively positioning the armature along the axis, the stator structure is separated from the armature by an air gap that includes a non-ferromagnetic guide sleeve that is in surface-to-surface contact with the armature for guiding armature motion along the axis, the guide sleeve and the stator structure are mutually overlapping along a region of the axis and are fit to substantial mutual concentricity with the axis, and at that region, the air gap includes a minimum air gap provided by radial spacing between the stator structure and the guide sleeve, wherein the stator structure comprises a first pole piece having a cylindrical hub at one axial end of the guide sleeve and second pole piece having a cylindrical hub at the other axial end of the guide sleeve, and wherein the guide sleeve is fit to substantial mutual concentricity with the axis by mutual surface-to-surface contact with the hub of each pole piece and the minimum air gap comprises minimum air gaps disposed at the hub of each pole piece.

7. An emission control valve as set forth in claim 6 wherein the mechanism comprises a spring that resiliently biases the valve element toward closure of the passage, and the energization of the coil operates the valve element against the spring bias to open the passage.

8. An emission control valve as set forth in claim 6 wherein the guide sleeve is fit to substantial mutual concentricity with the axis by mutual surface-to-surface contact with the hub of at least one of the pole pieces via a radially outward protruding bead in the guide sleeve.

* * * * *